US007208682B2

(12) United States Patent
Kuchta et al.

(10) Patent No.: US 7,208,682 B2
(45) Date of Patent: Apr. 24, 2007

(54) ELECTRICAL CABLE WITH FOAMED SEMICONDUCTIVE INSULATION SHIELD

(75) Inventors: Frank L. Kuchta, Columbia, SC (US); Stephen H. Foulger, Clemson, SC (US); Jason Carden, Greenwood, SC (US); Chengjun Liu, Lexington, SC (US); Andrew Maunder, Greenwood, SC (US); Alberto Bareggi, Milan (IT); Luca Balconi, Bresso (IT); Cristiana Scelza, Angellara di Vallo Della Lucania (IT)

(73) Assignee: Prysmian Cavi e Sistemi Energia SrL, Milan (IT)

( * ) Notice: Subject to any disclaimer, the term of this patent is extended or adjusted under 35 U.S.C. 154(b) by 0 days.

(21) Appl. No.: 10/537,707

(22) PCT Filed: Dec. 11, 2002

(86) PCT No.: PCT/US02/39416

§ 371 (c)(1),
(2), (4) Date: Jun. 3, 2005

(87) PCT Pub. No.: WO2004/053896

PCT Pub. Date: Jun. 24, 2004

(65) Prior Publication Data

US 2006/0102376 A1 May 18, 2006

(51) Int. Cl.
*H01B 7/00* (2006.01)

(52) U.S. Cl. ..... 174/110 R; 174/120 R; 174/120 SC

(58) Field of Classification Search ..... 174/102 R, 174/102 SC, 106 SC, 107, 110 R, 120 R, 174/120 SC, 23 R, 105 SC
See application file for complete search history.

(56) References Cited

U.S. PATENT DOCUMENTS

| | | | | | |
|---|---|---|---|---|---|
| 36,707 | A | * | 10/1862 | Marin et al. | 474/127 |
| 4,145,567 | A | * | 3/1979 | Bahder et al. | 174/107 |
| 4,356,139 | A | * | 10/1982 | Rowland et al. | 264/171.19 |
| 4,458,105 | A | * | 7/1984 | Roenisch et al. | 174/106 D |
| 5,246,783 | A | * | 9/1993 | Spenadel et al. | 428/461 |
| 6,086,792 | A | * | 7/2000 | Reid et al. | 252/511 |
| 6,284,374 | B1 | * | 9/2001 | Yamazaki et al. | 428/383 |
| 6,514,608 | B1 | * | 2/2003 | Foulger | 428/372 |
| 6,524,702 | B1 | * | 2/2003 | Betso et al. | 428/379 |
| 6,797,886 | B1 | * | 9/2004 | Gustafsson et al. | 174/110 R |
| 6,864,429 | B2 | * | 3/2005 | Easter | 174/110 R |
| 2001/0030053 | A1 | * | 10/2001 | Gadessaud et al. | 174/102 SC |

FOREIGN PATENT DOCUMENTS

| | | | | |
|---|---|---|---|---|
| EP | 0707322 | A1 | | 4/1996 |
| JP | 08-287741 | A | * | 11/1996 |
| WO | WO 99/33070 | A | * | 7/1999 |
| WO | WO 99/33070 | | | 7/2000 |

* cited by examiner

*Primary Examiner*—William H. Mayo, III
(74) *Attorney, Agent, or Firm*—Norris, McLaughlin & Marcus, PA

(57) ABSTRACT

An electrical power cable with a foamed, compressible, semiconductive insulation shield which serves as both a cushioning layer and an electrical shield.

37 Claims, 6 Drawing Sheets

ELECTRICAL CABLE WITH FOAMED SEMICONDUCTIVE INSULATION SHIELD

BACKGROUND OF THE INVENTION

1. Field of the Invention

The present invention relates to electrical cables, with an improved semiconductive insulation shield and the method of making the same. More specifically, the invention is concerned with an electrical cable with a foamed semiconductive insulation shield which serves as both a cushioning layer and an electrical shield. Preferably, the foamed semiconductive insulation shield is a closed-cell foamed semiconductive insulation shield.

2. The Related Art

Electric power cables for medium and high voltage typically include a central core electrical conductor of copper or aluminum, an overlaying semiconductive conductor shield, an electrical insulation layer formed over the conductor shield, a semiconductive insulation shield and a metallic shield overlaying the insulation shield. Preferably, an overall plastic jacket is positioned radially external to said metallic shield. The thickness of each of these layers is determined by voltage rating and conductor size and is specified by industry standards such as those published by the Insulated Conductors Engineering Association (ICEA), the Association of Edison Illuminating Companies (AEIC), and Underwriters Laboratories (UL). Electrical cable performance criteria are specified and tested according to AEIC and ICEA standards. The conductor shield is most often a semiconducting polymer extruded over the electrical conductor. The insulation layer is usually a thermoplastic or thermoset material such as crosslinked polyethylene (XLPE), ethylene-propylene rubber (EPR), or polyvinyl chloride (PVC). The insulation layer may include additives to enhance the life of the insulation. For example, tree retardant additives are often added to XLPE to inhibit the growth of water trees in the insulation. The insulation shield is usually an extrudable semiconducting polymer. The insulation shield must have a smooth interface with the insulation layer and exhibit an acceptably low voltage drop through its thickness and eliminate discharge. The AEIC specifies that the insulation shield must have a volume resistivity of less than 500 Ω·m (Ohms× meters) at 90° C. and 110° C. Insulation shields usually form a layer which is adhered to the insulation layer, or for high voltage cables, bonded to the insulation layer. The metallic shield overlaying the insulation shield may consist of, for example, a lead or aluminum sheath, a longitudinally applied corrugated copper tape with an overlapped seam or welded seam, helically applied wires (i.e. drain wires or concentric neutral wires), or flat copper straps. It is important that the insulation shield be in electrical contact with the metallic shield. U.S. Pat. No. 5,281,757 (hereinafter the '757 patent) and U.S. Pat. No. 5,246,783, the contents of both of which are incorporated herein by reference, disclose examples of electric power cables and methods of making the same.

There is sometimes a semiconducting tape layer interposed between the insulation shield and the metallic shield. The purpose of this tape may be for waterblocking, cushioning, or both. If for cushioning or bedding, this tape most often is employed in conjunction with a metallic shield comprised of lead or aluminum sheaths, copper tape with or without welded seam or with sealed overlap longitudinally applied corrugated copper tapes as in the heretofore referenced '757 patent. The cushioning effect of the tape layer eases the pressure on the metallic shield due to the expansion and contraction of the electrical cable core resulting from varying load cycles on the cable. The use of cushioning or bedding layers are known under concentric neutral wire metallic shields; however, due to the expansion and contraction of the electrical cable core, the concentric neutral wires often indent the insulation shield. This indent is sometimes transferred to the insulation layer, causing a disruption of the cylindrical interface between the insulation shield and the insulation layer. This disruption leads to higher electrical stresses as well as to detachments of the semiconductive insulation shield from the electric insulation layer, which may result in premature failure of the insulation layer and the cable. The cushioning layers hereinbefore described add an expensive component to the cable and add an additional manufacturing step.

When splicing or terminating prior art electrical cables, the metallic shield is removed from the splice/termination area. Conventional splice and termination sleeves have portions that compress around the insulation shield. When the splice or termination is completed, a large void is present between the sleeve and the insulation shield because the insulation shield does not compress. These voids, if not properly or completely filled with a grease, can cause failure of the splice or termination due to partial discharge which will eventually erode the insulation layer.

U.S. Pat. No. 4,145,567 to Bahder discloses an electric power cable which employs a semiconducting compressible layer of closed-cell foamed plastic extruded over the insulation shield and under a metallic shield comprised of a longitudinally folded tape with bonded or welded overlap seam. As the cable core becomes highly heated, it expands and increases in cross-section. The compressible layer between the insulation shield and the inside surface of the metal shield accommodates the expansion of the core by decreasing in radial thickness. When the cable core cools, the compressible layer expands again, so that it maintains contact with the cable core and the metal shield at all times. In this way, the pressure exerted by the compressible layer against the insulation shield and the metallic shield is sufficient to prevent any flow of fluid lengthwise of the cable if the metal shield becomes punctured by lightening or other cause. Examples given for Bahder's compressible layer are EPR which is either semiconducting when used with a copper metallic shield or filled with high dielectric constant fillers such as titanium dioxide, barium titanate, or magnesium zirconate. Furthermore, according to Bahder extruding the compressible layer is an additional manufacturing step and the problem of voids in splices and terminations is not alleviated. Moreover, the compressible layer disclosed by Bahder functions as a cushioning layer which is used in electric cable constructions in addition to an insulation shield.

Document WO 99/33070 in the name of the Applicant describes the use of a layer of expanded polymeric material arranged in direct contact with the semiconductive insulation shield of a cable, in a position directly beneath the metallic screen of the cable, and possessing predefined semiconductive and waterblocking properties with the aim of guaranteeing the necessary electrical continuity between the conductor and the metallic screen.

SUMMARY OF THE INVENTION

From the related art documents mentioned above it is apparent that there was a technical prejudice in the field according to which a foamed layer were to be considered unsuitable for being used as the semiconductive insulation shield of a cable since the presence of voids within the semiconductive foamed layer was believed to be dangerous from the electrical point of view. In fact all said documents disclose an electrical cable comprising a compact, i.e. non-foamed, insulation shield which can be associated with a foamed layer for providing the cable with waterblocking and/or impact resistance properties.

Nevertheless, the Applicant perceived that a semiconductive foamed layer could be used as an insulation shield without running the risk that electrical failures (e.g. partial discharges) can occur. Furthermore, the Applicant perceived that said foamed, i.e. compressible, layer could be used as both an insulation shield and a cushioning layer suitable for elastically and uniformly absorbing the radial forces of expansion and contraction of the cable due to thermal cycles thereof during use:

Therefore, the Applicant found an improved electrical power cable, preferably for medium or high voltage applications, comprising an electrical central core conductor, an overlaying semiconductive conductor shield, an insulation layer overlying the conductor shield, a foamed, compressible and semiconductive insulation shield, and a metallic shield overlying the foamed insulation shield. Preferably, the foamed semiconductive insulation shield is a closed-cell foamed semiconductive insulation shield. The foamed insulation shield serves as both an insulation shield and a cushioning or compressible layer. Thus, for electrical cables with solid, bonded metallic shields, or longitudinally folded and bonded overlap metallic tape, a cushioning layer is provided by the insulation shield itself to compensate for the expansion and contraction of the cable core with varying loads, thereby eliminating the need for separate tapes or cushion layers. Additionally, because the entire insulation shield is compressible, there will be less void to fill compared to conventional insulation shields during splices and terminations. That is, accessory reliability enhancement is achieved because the foamed insulation shield will conform to the splice/termination sleeve such that only a small void remains between the sleeve and the insulation shield. This small void is easier to fill. This significantly decreases the likelihood of failure due to partial discharge and eventual erosion of the insulation layer. The foamed insulation shield of the present invention can also be used under concentric neutral wires to eliminate insulation layer indent. Because the foamed insulation shield of the present invention is the same thickness as conventional insulation shields, less material is used in its manufacture and therefore the cost of the insulation shield is significantly less than conventional insulation shields. Additionally, because the foamed insulation shield of the present invention comprises the entire insulation shield, the additional manufacturing steps of applying tape layers, cushioning or compressible layers over the conventional insulation shield are eliminated.

Accordingly, the invention has numerous advantages and applications. Therefore, it is one object of the present invention to provide an electrical power cable which incorporates a foamed insulation shield which functions not only as an insulation shield but also as a cushioning layer which allows for expansion and contraction of the cable core during cable load cycles without putting undue stress on the metallic shield or on the underlying insulation layer.

It is a further object of the invention to eliminate the need for a separate cushioning layer, such as semiconducting tape, between the insulation shield and the metallic shield of an electrical power cable, thus decreasing the cost of the cable and eliminating a process step in cable manufacture.

It is another object of the invention to provide an electrical power cable which eliminates insulation layer indent from concentric neutral wires.

It is a still further object of the invention to provide an electrical power cable which reduces the voids present in splices and terminations.

It is a still further object of the invention to provide a method of making an electrical power cable with a foamed insulation shield wherein the conductor shield, insulation layer, and the foamed insulation shield are triple-extruded into a pressure vessel (i.e. CV curing tube).

BRIEF DESCRIPTION OF THE DRAWINGS

Other objects and advantages of the present invention will be apparent from the following detailed description of the presently preferred embodiments in conjunction with the accompanying drawings in which.

DETAILED DESCRIPTION OF THE INVENTION

Figure 1:
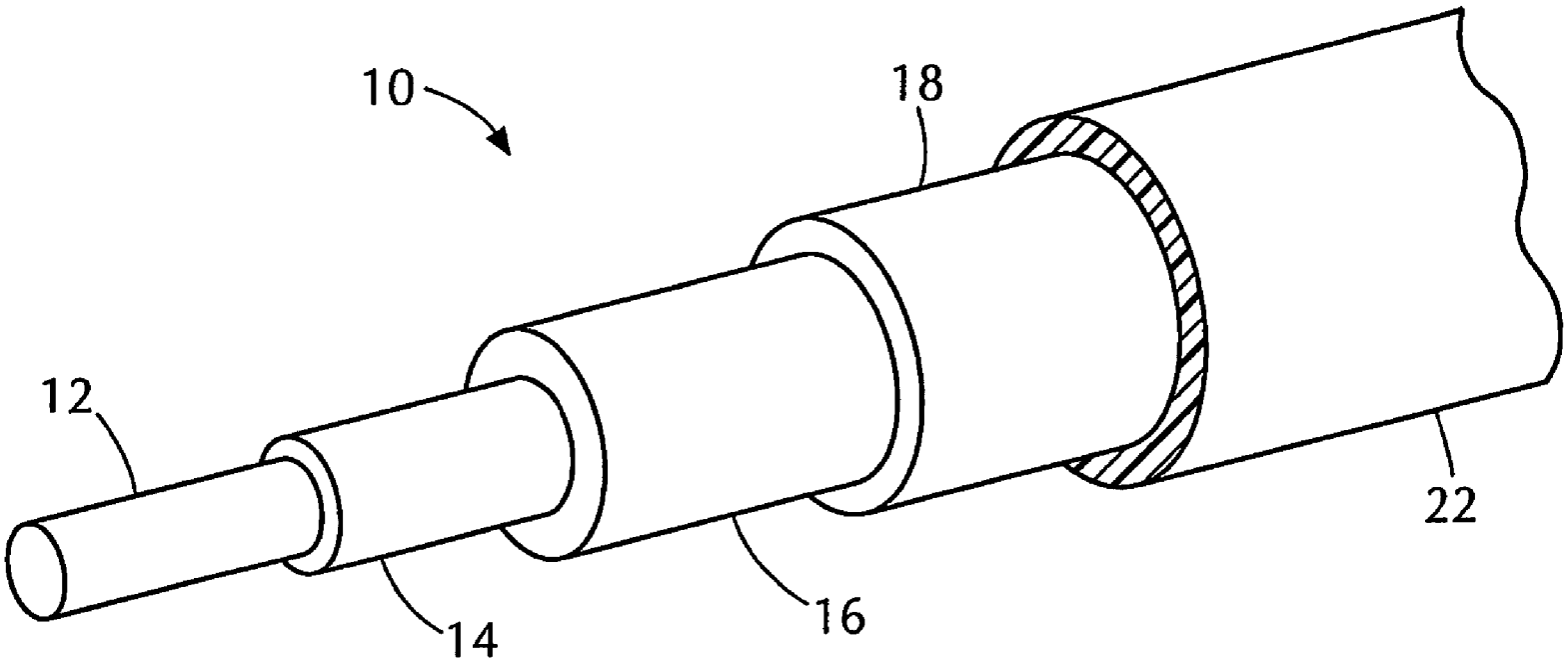
FIG. 1 is an illustration of an electric power cable of the present invention incorporating the foamed insulation shield under a metallic shield.

Referring to FIG. 1, a shielded electrical cable 10 of the present invention comprises an electrical central core conductor 12, an overlaying conductor shield 14, at least one insulation layer 16 formed over the conductor shield, a closed cell foamed semiconductive insulation shield 18 formed over and adhered to the insulation layer 16, and an outer metallic shield 22. Preferably, an overall plastic jacket (not shown) is included.

The central core conductor 12 may be a solid conductor as shown or it may be stranded. The core conductor is preferably of aluminum or copper. The overlaying conductor shield 14 is preferably a semiconducting crosslinked polymer. Suitable conductor shields are available from many commercial sources as would be known to one skilled in the art. The insulation layer 16 is preferably an XLPE, a tree retardant XLPE (TRXLPE), an EPR, or an EPDM, all of which are crosslinked insulations, and are commercially available in the industry. The metallic shield 22 may be a solid or bonded metallic layer of lead or aluminum or it may be a longitudinally folded copper or aluminum tape with an overlap seam welded or sealed with an adhesive which allows the overlap seam to move with variations in temperature as described in the '757 patent. The metallic shield might also be helically applied concentric neutral wires and/or copper tape. The overall plastic jacket (not shown) is preferably an insulative thermoplastic polymer, for example, polyvinyl chloride (PVC) or a polyethylene (PE).

The foamed semiconductive insulation shield 18 is preferably comprised of a base material, which may advantageously be one of a number of commercially available materials marketed for insulation shield applications, such as LE-315A supplied by Nova Borealis or HFDA-0693 or HFDC-0692 supplied by Union Carbide Corporation. It is preferable that the base material be comprised of a crosslinkable ethylene acetate such as ethylene vinyl acetate (EVA), ethylene butyl acetate (EBA), or ethylene ethyl acetate (EEA), with other additives such as processing aids, secondary resins, and chemical crosslinking agents and aids. The insulation shield base material must be filled with a conductive filler, such as carbon black, preferably in an amount from about 20% to about 40% by weight, or in any event, in an amount sufficient for the insulation shield to exhibit a volume resistivity of less than about 500 Ω·m. The insulation shield is foamed, in general, by adding a chemical foaming agent to the base material prior to extrusion of the base material onto the insulation layer. The insulation shield is foamed such that the density reduction of the insulation shield is between about 10% to about 40%. Less than about 10% density reduction does not provide many benefits. Greater than about 40% density reduction, depending on the materials employed, usually will result in a degradation of material properties needed for an insulation shield for electrical cables.

The chemical foaming agent is activated by heat from a continuous vulcanization (CV) process. The chemical foaming agent decomposes, releasing a gas, and thereby foams the insulation shield base material. The chemical foaming agent is selected such that its activation or decomposition temperature is greater than the extrusion temperature so that decomposition of the foaming agent occurs after extrusion and substantially simultaneous with the crosslinking of the conductor shield, the insulation layer and the insulation shield, as will be described in more detail hereinafter. The chemical foaming agent may be of the endothermic or exothermic type or a hybrid endothermic/exothermic agent. The chemical foaming agents may be added directly to the insulation shield base material and mixed before extrusion, or more preferably the chemical foaming agents are supplied in a masterbach with a compatible carrier resin, preferably an EVA, an EBA, or an EEA and mixed with the insulation shield base material in an amount of from about 1% to about 8% by weight of the insulation shield base material when mixed. It is important that the chemical foaming agent be well dispersed in the insulation shield base material. Good dispersion is dependent on the mixing and extrusion equipment and the relative melt flow indices (MFI) of the chemical foaming agent masterbach and the insulation shield base material. In the examples which follow, good dispersion of the chemical foaming agent in the insulation shield base material was achieved in a 120 mm diameter extruder with a length to diameter ratio of 20:1 utilizing a Barrier Flight Mixing Screw and a chemical foaming agent masterbach resin with an MFI greater than that of the insulation shield base material. As is known in the art, good dispersion is both a function of shear rates in the mixer and relative viscosities of the components.

The choice of whether to use an endothermic, exothermic, or hybrid chemical foaming agent may depend on the selection of the base material for the insulation shield and compatibility therewith, extrusion profiles and processes, CV process and parameters, the desired amount of foaming, cell size, and structure, as well as other design considerations particular to the cable being produced. In general, given similar amounts of active ingredient, exothermic chemical foaming agents will reduce density the most and produce a foam with larger cells. Endothermic foaming agents produce foams with a finer cell structure. This is a result, at least in part, of the endothermic foaming agent releasing less gas and having a better nucleation controlled rate of gas releases than an exothermic foaming agent. Thus, the resulting foam will have an increase in the number of voids but a decrease in the size of the voids. This may, in some systems, provide a smoother interface between the insulation shield and the insulation layer. Use of hybrid foaming agents results in a lower gas yield than an exothermic foaming agent and, therefore, smooth surfaces and a finer cell structure are produced while at the same time retaining some of the benefits of an exothermic foaming agent. Representative foaming agents which may be used include CELOGEN® OT from Uniroyal Chemical, an exothermic foaming agent; azodicarboamide, an exothermic foaming agent; or one of the following foaming agents marketed by Clariant of Winchester, Va.: HYDROCEROL® BIH 40 E, an endothermic foaming agent; HYDROCEROL® CT1267, a hybrid exothermic/endothermic foaming agent; HYDROCEROL® CT1271, a hybrid exothermic/endothermic foaming agent; HYDROCEROL® CT1555, a hybrid exothermic/endothermic foaming agent; HYDROCEROL® CT1557, a hybrid exothermic/endothermic foaming agent; HYDROCEROL® CT1376, an exothermic foaming agent; and HYDROCEROL® CT1542, an exothermic foaming agent. Considerations for selection of chemical foaming agents will be described hereinafter. In some cases, a catalyst material may be included in the masterbach, especially when employing an exothermic foaming agent. The catalyst material may be used to adjust the decomposition temperature of the foaming agent. A suitable catalyst material is BIK® OT (registered trademark of Uniroyal Chemical).

The interface between the foamed semiconductive insulation shield and the insulation layer is preferably substantially void-free. Thus, the foamed semiconductive insulation shield preferably has a closed-cell structure so as not to provide channels for water propagation between the insulation layer and the insulation shield, for mechanical strength, to ensure electrical continuity, and to assist in forming a skin 24 at the interface between the insulation shield 18 and the insulation layer 16 as open cells or voids at the interface may result in partial discharge and erosion of the insulation layer. The choice of chemical foaming agent, carrier, and processing conditions significantly affect the formation of the skin or the smoothness of this interface also.

In accordance with the present invention, a preferred method of making the electrical cable with a foamed semiconductive insulation shield is described. An electrical central core conductor is advanced on a conventional cable extrusion line through an extrusion crosshead. A semiconductive conductor shield is extruded onto the electrical conductor. A crosslinkable insulation layer is extruded onto the conductor shield. A crosslinkable insulation shield material having a chemical foaming agent incorporated therein is extruded over the insulation layer. Preferably, the conductor shield, the insulation layer and the insulation shield material are triple-extruded. Alternatively, the conductor shield is extruded separately, and the insulation layer and insulation shield are co-extruded. The chemical foaming agent and the extrusion temperature are selected so that the decomposition temperature of the chemical foaming agent is greater than the extrusion temperature. In this manner the decomposition of the foaming agent will not occur during extrusion. After exiting the extruder, the electrical cable is advanced into a conventional CV tube. The CV tube is at an elevated temperature to supply heat in order to activate the crosslinking agents in the conductor shield, the insulation layer and in the insulation shield material. The heat of the CV tube must be sufficient to both crosslink the conductor shield, the insulation layer and insulation shield and to decompose the chemical foaming agent.

The Applicant has found that the distance/time that the insulation shield material is maintained above the decomposition temperature in the CV tube is an important parameter for obtaining the desired density reduction (and possibly surface quality) in the insulation shield due to foaming. In one instance the Applicant has found that when the insulation shield attains a temperature in the CV tube just above the foaming agent's decomposition temperature, the density reduction of the insulation shield due to foaming was increased from a 5% reduction to a 26% reduction by increasing the time the shield was kept above the decomposition temperature by about 1.5 times, from 5.8 minutes to 8.5 minutes. Keeping all other parameters constant, the Applicant has found that reducing the decomposition temperature of the foaming agent, decreasing the line speed to increase this time, or alternating the temperature profile of the CV tube to increase this time, will each aid in obtaining the desired density reduction. Further, while, for example, the decomposition temperature may be around 200° C. [~390° F.] (or significantly less such as about 160° C. [~320° F.] depending on the foaming agent used) many of the foaming agents suitable for the present invention have a recommended processing temperature range of 210° C. to 240° C. [~410° F. to 464° F.] (or more, again depending on the foaming agent used) to achieve optimum gas yield. Thus, it was found that even if linespeed were increased, thereby decreasing the time the insulation shield was above the decomposition temperature to about 3 minutes, satisfactory results could still be obtained by altering the tube temperature profile such that the insulation shield was in the recommended processing temperature range of the foaming agent for more than one minute.

In a dry cure CV line, the CV tube is usually at a temperature of about 400° C. [750° F.] and pressurized with nitrogen gas to about 135 psi to about 150 psi. In a steam-cure CV line, the CV tube is pressurized with saturated steam to a range of about 200 psi to about 260 psi at a temperature of about 193° C. [380° F.] to about 210° C. [410° F.]. In the case of using superheated steam, the CV tube is electrically heated to about 380° C. [715° F.] with the tube pressurized with steam to about 150 psi to about 200 psi. The CV tubes are pressurized in order to prevent foaming of the insulation layer due to the decomposition of the crosslinking agent when crosslinking. Thus, foaming the insulation shield in the CV line is counterintuitive. The chemical foaming agent decomposition, crosslinking, and foaming of the insulation shield occur in the CV tube substantially concurrently. The decomposition of the foaming agent is preferably complete before the crosslinking of the insulation shield is complete. The cable is then cooled and a metallic shield may be applied either on the same manufacturing line or, most often, in a separate operation.

Generally in the art, foaming of polymers is done at ambient pressure or in a vacuum. Thus, decomposition of the chemical foaming agent under the high pressure of the CV tubes as in the present invention is unique in the art. While the foamed insulation shield could be applied over the insulation layer in a separate extrusion operation, thereby eliminating the complications of decomposing the chemical foaming agent under the pressure of the CV tube, this separate additional extrusion step would increase the cost of manufacturing, could promote defects at the insulation layer/insulation shield interface, and defeat one of the objects of the present invention; that is, to provide an electrical power cable which incorporates an insulation shield that also functions as a cushioning layer, thus decreasing the cost of the cable and eliminating a process step in cable manufacture.

Successful practice of the present invention was accomplished using exothermic, endothermic, and hybrid chemical foaming agents in an EVA-based insulation shield base material. The following examples provide further details on the preparation of cables of the present invention.

The preferred insulation shield material (as used In Examples 1–4) is an EVA-based material having a primary resin of EVA with a 45% vinyl acetate (VA) content in an amount of about 45% to about 55% by weight of the insulation shield material. A secondary resin of nitrile rubber (NBR) with an acrylonitrile (ACN) content of about 33% in the amount of about 10–20% by weight is included. Carbon black in an amount sufficient to make the insulation shield material semiconductive, typically about 20–40%, is included. Other additives, typical to insulation shield materials such as antioxidants, processing aids and crosslinking agents in amounts less than about 5% each are also included. However, it is the polymer system, the EVA with about 45% VA content, and NBR with 33% ACN content that makes this insulation shield material preferred with the specific chemical foaming agents employed. When other chemical foaming agents contained in various other masterbaches are employed, a different polymer system for the insulation shield may be the preferred. The aforementioned base material for the insulation shield of Examples 1–4 was used initially because it was thought that modifications to the base material may be necessary to produce good foamed insulation shields. Surprisingly, this was not the case. It was found that adhering to the selection criteria of material for the chemical foaming agent and its masterbach, in relation to the base material employed, was the greatest determinant of success, along with the processing conditions.

EXAMPLES 1–2

Semiconductive insulation shields according to the present invention, employing exothermic chemical foaming agents, were extruded along with the conductor shield and insulation layer onto No. 1/0 American Wire Gauge (AWG) conductor and foamed and crosslinked in a nitrogen gas ($N_2$) environment at elevated temperature and pressure. Table 1 gives the formulations and process conditions for Examples 1–2.

TABLE 1

| Example | Foaming Agent/Type | Insulation Shield Composition | Insulation | CV Curing Process Conditions | Linespeed (fpm) |
|---|---|---|---|---|---|
| 1 | Celogen OT Exothermic Decomp. Temp: 175° C.–220° C. (347° F.–428° F.) | 100 pphr EVA Base Resin and additives (carbon black, chemical crosslinking agent, processing aids); 2.52 pphr Celogen OT 1.05 pphr BIK OT catalyst | TRXLPE | $N_2$ at 135 psi and tube zone Temperatures: 750/750/750/725/725/700° F. | 35 |
| 2 | Hydrocerol CT1376 Decomp. Temp: 190° C. (374° F.) | 96% by weight EVA Base Resin and additives (carbon black, chemical crosslinking agent, processing aids): 4% by weight CT1376 (40% Active content in EVA carrier | EPR | $N_2$ at 135 psi and tube zone Temperatures: 725/725/700/700/675/650° F. | 54 |

Notes:
pphr = parts per hundred rubber
fpm = feet per minute

Examples 1 and 2 exhibited a density reduction of 32% and 20% respectively. Example 1 was further processed by helically applying six No. 14 AWG copper concentric neutral wires and extruding over these wires an overall plastic jacket. It was observed that the concentric neutral wires created an indent in the foamed insulation shield; however, importantly, the indent did not transfer through to the insulation layer. Further, upon application of heat, the indent disappeared.

Figure 2:
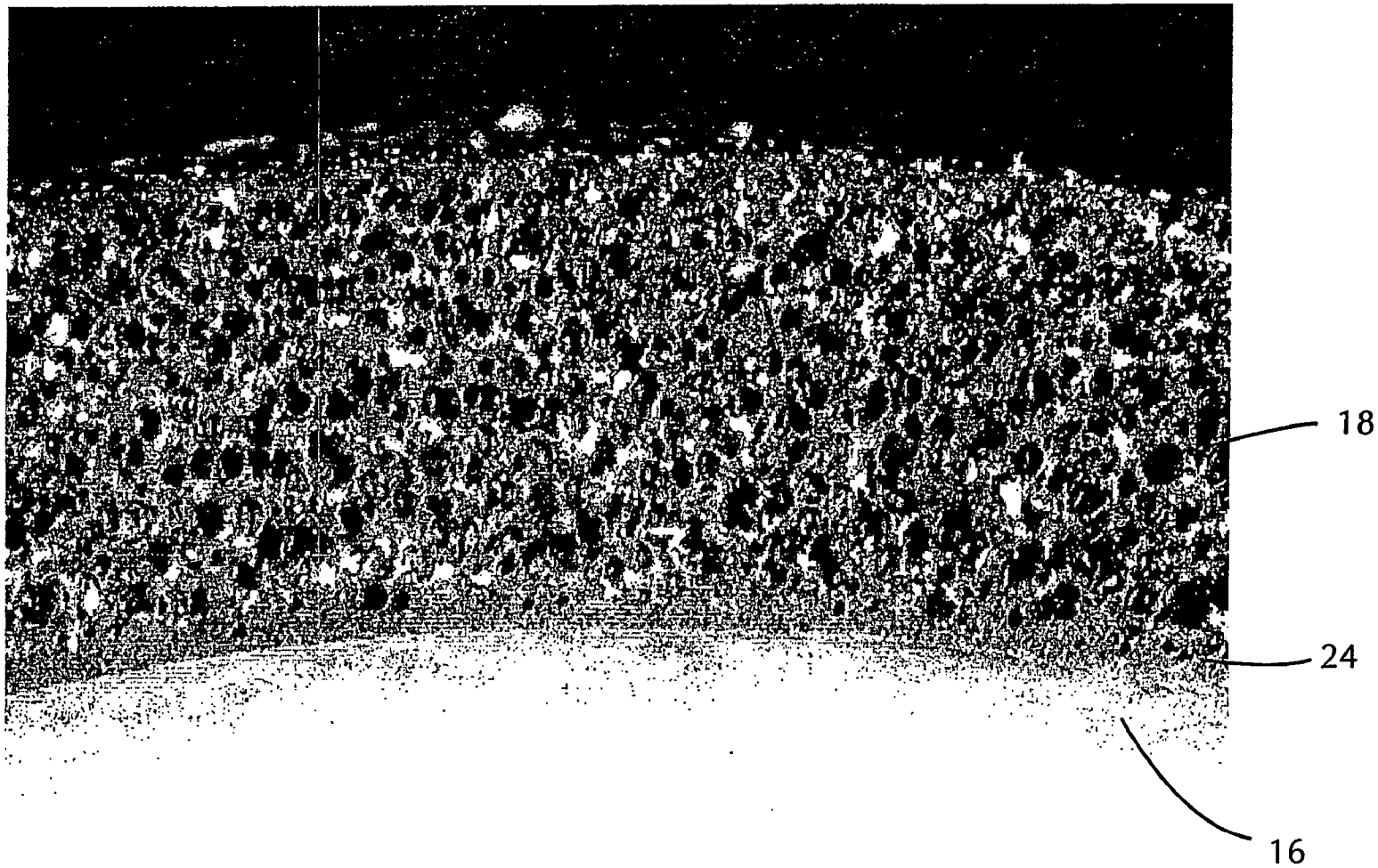
FIG. 2 is an optical micrograph of a cross-section of the foamed insulation shield of the present invention made using an exothermic foaming agent and a catalyst, when the nitrogen pressure used during manufacturing was 135 psi.

FIG. 2 is a cross-sectional view of the foamed insulation shield 18 of Example 1, which shows more closely the closed-cell structure of the foamed insulation shield 18 and the "skin" 24 which formed at the insulation shield/insulation layer interface.

As seen in Table 1, the foamed insulation shield of Example 1 included a catalyst in order to lower the start of decomposition of the chemical foaming agent by approximately 15° C. (27° F.), from about 190° C. (374° F.) to about 175° C. (347° F.). Other experimental cables made with the same process conditions and foamed insulation shield composition as Example 1, except without the catalyst, showed inferior surface quality and inferior electrical performance as compared to the cable of Example 1. The results of lowering the decomposition temperature of the foaming agent in Example 1 demonstrates the importance and relationship between the decomposition temperature of the foaming agent and the process conditions in the CV curing tube in obtaining a satisfactory foamed insulation shield.

The cable of Example 1 was subjected to the standard qualification testing for electric power cable performance as specified by AEIC. These tests included: volume resistivity, high voltage time testing analysis (HVTT), and partial discharge (PD) analysis. Example 1 passed the AEIC specification for volume resistivity, with a value of 2 Ω·m at 90° C. and 0.45 Ω·m at 110° C., well within the AEIC requirement of <500 Ω·m at 90° C. and 110° C. The cable of Example 1 also passed the AEIC specification for HVRT, with a value of 700 volts/mil (V/mil) unconditioned and 1200 V/mil after conditioning at 100 hours at 90° C. The AEIC specification for partial discharge is: PD<5 pico-Columbs (pC) at 4 Vg (4 times the rated voltage to ground). Example 1 had an inception level of PD at 20 kV and at 4 Vg (in this case 35 kV) of 5 pC.

The cable of Example 2 was observed to have superior surface quality. The foamed insulation shield of the cable of Example 2 was subjected to testing for insulation shield physical properties at original and aged 7 days at 121° C. and 136° C.; hot creep/set at 150° C.; bond strength at ambient temperature, −10° C., and +40° C.; and field strippability at +40° C. The results of these tests demonstrated that the insulation shield of Example 2 met and/or exceeded applicable AEIC/ICEA industry specifications.

Figure 3:
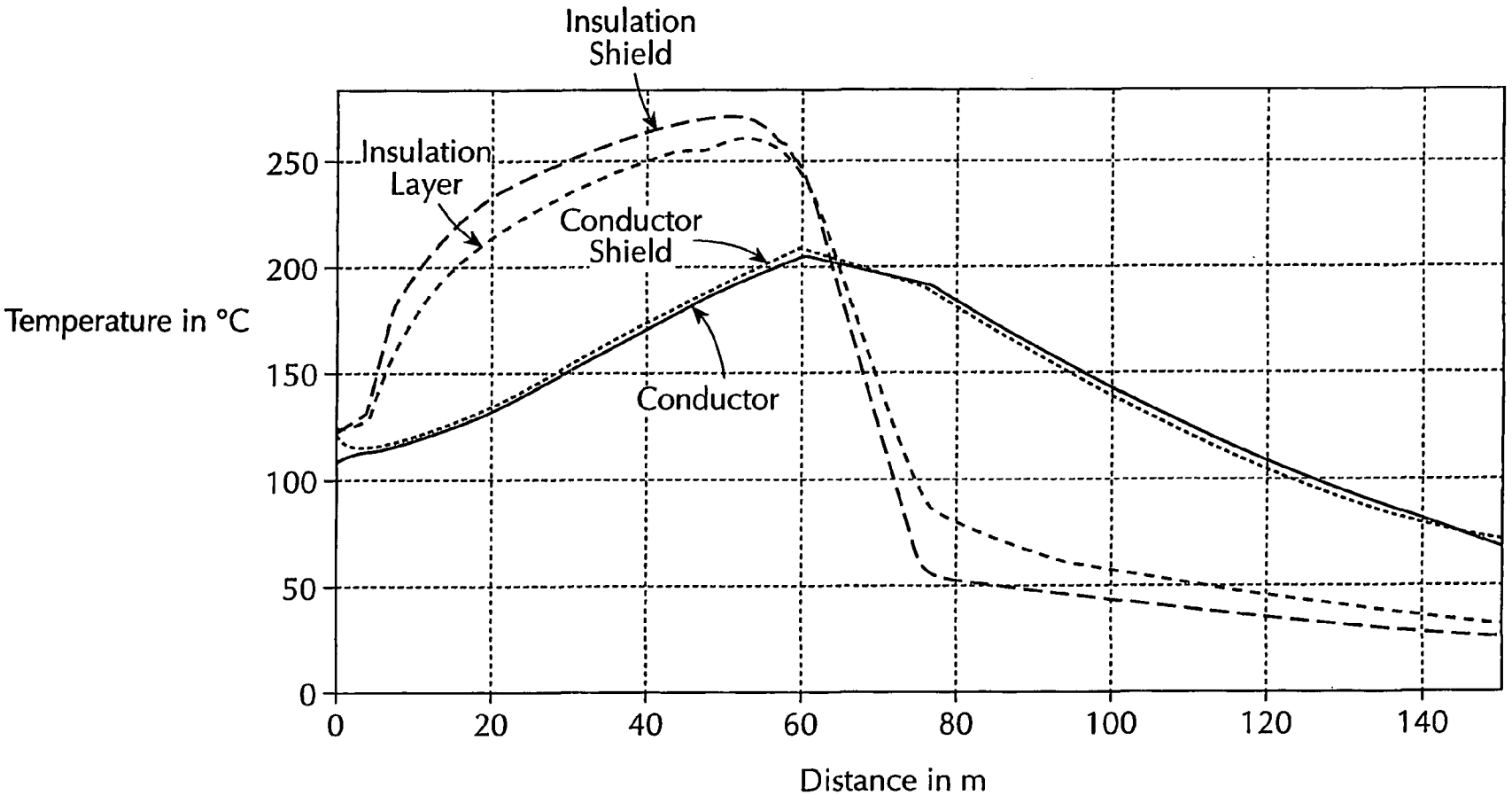
FIG. 3 is a graph showing the distance/temperature profile of the continuous vulcanization (CV) tube in Example 2.

FIG. 3 shows the distance/temperature profile of the CV tube for Example 2. It can be seen that the insulation shield obtained a temperature above the decomposition temperature of the foaming agent for about 55 meters, or 3.33 minutes, based on the linespeed of 54 fpm in Table 1. The time the insulation shield was in the recommended working range of the foaming agent for optimum gas yield was about 1.2 minutes. Lengthening this time by reducing the decomposition temperature of the foaming agent with the addition of a catalyst, slowing down the linespeed, or by increasing the temperatures of the latter heating zones of the tube would all help increase the density reduction if desired.

EXAMPLE 3

A semiconductive insulation shield according to the present invention, employing a hybrid exothermic/endothermic chemical foaming agent, was extruded along with a conductor shield and an insulation layer onto No. 1/0 AWG conductor (approximate equivalent of 53.49 $mm^2$ metric conductor), and foamed and crosslinked in a steam environment at elevated temperature and pressure. Table 2 gives the formulations and process conditions for Example 3.

TABLE 2

| Example | Foaming Agent/Type | Insulation Shield Composition | Insulation | CV Curing Process Conditions | Linespeed (fpm) |
|---|---|---|---|---|---|
| 3 | Hydrocerol CT1271 Hybrid: Endothermic/ Exothermic Decomp. Temp: 190° C. | 96% by weight EVA Base Resin and additives (carbon black, chemical crosslinking agent, processing aids); 4% by weight CT 1271 (70% Active content in EVA carrier) | EPR | Steam at 203 psi and tube temperature zones 1–4 at 715° F. | 6.6 |

The foamed insulation shield of Example 3 achieved a density reduction of about 28% and had very good surface quality. When tested for partial discharge according to AEIC requirements, Example 3 exhibited less than 2 pC at 52 kV, which meets AEIC standards. Example 3 demonstrates that the foamed insulation shield of the present invention may be achieved on steam cure CV lines.

Figure 4:
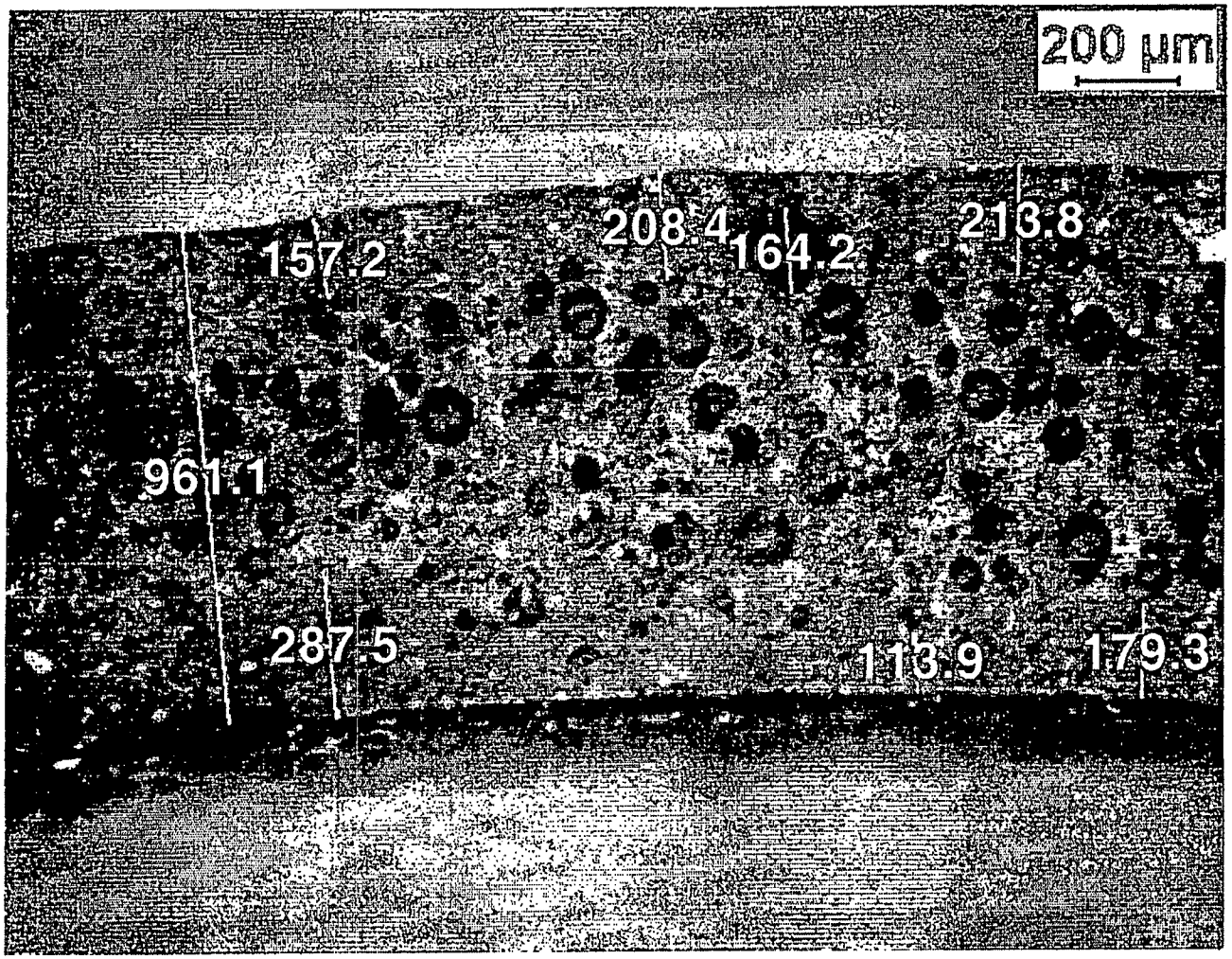
FIG. 4 is an optical micrograph of a cross-section of the foamed insulation shield of the present invention made using a hybrid exothermic/endothermic foaming agent, cured in a steam CV tube.
Figure 5:
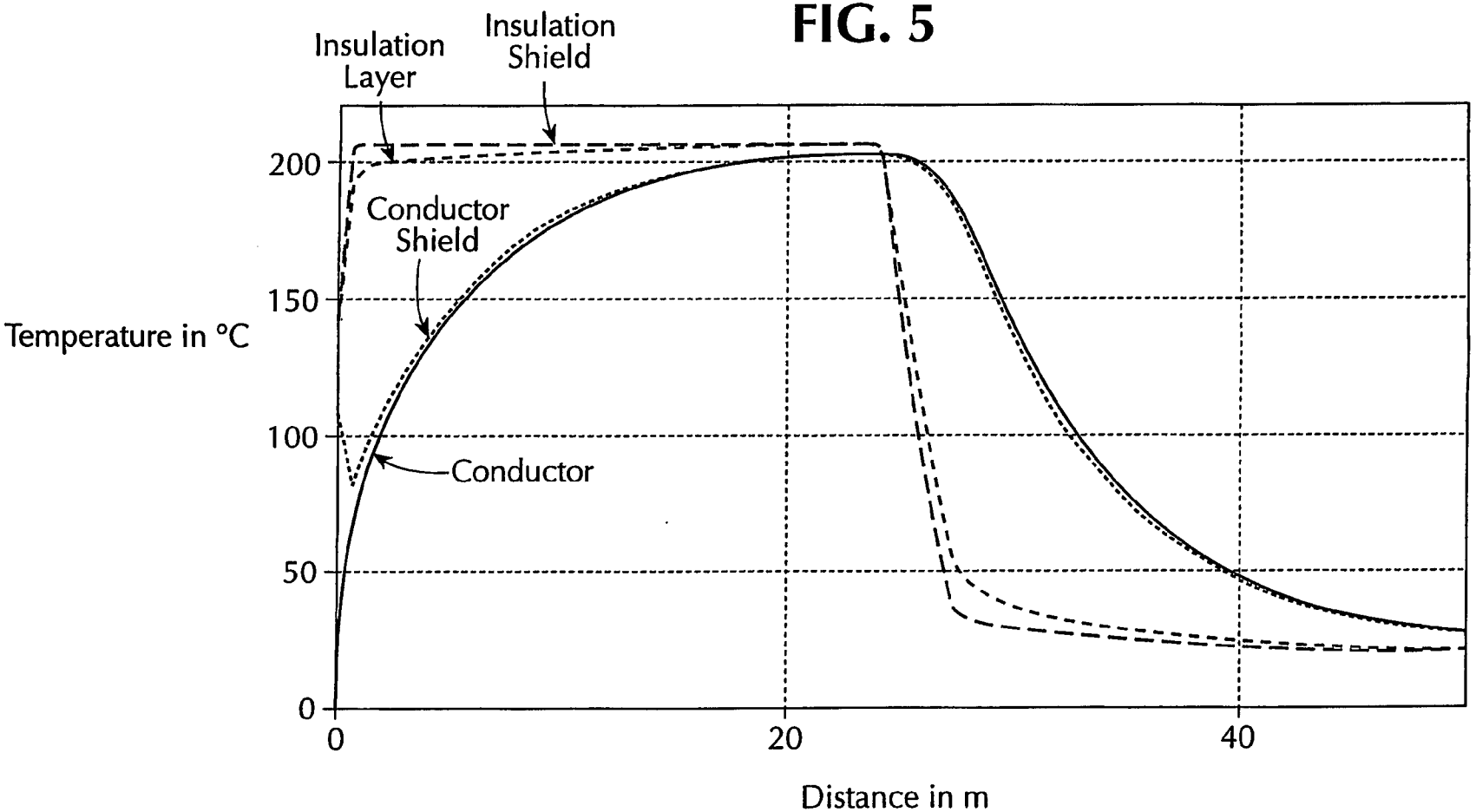
FIG. 5 is a graph showing the distance/temperature profile of the CV tube in Example 3.

FIG. 4 shows in cross-section the cell structure and skin of the foamed insulation shield of the present example. FIG. 5 shows the distance/temperature profile of the CV tube for Example 3. It is noted that the insulation shield was just above (200° C.) the decomposition temperature of the foaming agent (190° C.) for 11.6 minutes, based on the linespeed in Table 2, resulting in a 28% density reduction of the insulation shield.

EXAMPLE 4

A semiconductive insulation shield according to the present invention, employing a hybrid exothermic/endothermic chemical foaming agent, was extruded along with a conductor shield and insulation layer onto No. 1/0 AWG conductor, and foamed and crosslinked in a $N_2$ environment at elevated temperature and pressure. Table 3 gives the formulations and process conditions for Example 4.

TABLE 3

| Example | Foaming Agent/ Type | Insulation Shield Composition | Insulation | CV Curing Process Conditions | Linespeed (fpm) |
|---|---|---|---|---|---|
| 4 | Hydrocerol CT1271 Hybrid: Endothermic/ Exothermic Decomp. Temp: 190° C. | 96% by weight EVA Base Resin and additives (carbon black, chemical crosslinking agent, processing aids); 4% by weight CT1271 (70% Active content in EVA carrier) | EPR | $N_2$ at 135 psi and tube zone temperature 725/725/700/700/675/ 650° F. | 35 |

The foamed insulation shield of Example 4 achieved a density reduction of about 32%. The cable of Example 4 was tested according to AEIC requirements and successfully complied with those requirements. The tested cable passed wafer boil testing as specified in AEIC Standard CS6–94 Section G.2 which indicated the foamed insulation shield had been effectively crosslinked. The electrical testing data of the cable all met the AEIC specifications including those from the alternating current (AC) withstand, partial discharge, dissipation factor, hot impulse, and volume resistivity at room temperature, 90° C. and 130° C. The ambient bond strength, elongation at break in the original and aged states, and shield removability ranging from room temperature to +40° C., were also found to be well above the respective industrial requirements.

The cable of Example 4 experienced the same CV tube distance/temperature profile as shown in FIG. 3 for Example 2. However, because of the slower linespeed of the present example, the insulation shield was above the decomposition temperature of the foaming agent for 5.1 minutes and in the high end of the working temperature range of the foaming agent for almost 2 minutes.

EXAMPLE 5

A semiconductive insulation shield according to the present invention, employing an endothermic chemical foaming agent, was extruded along with a conductor shield and insulation layer onto No. 1/0 AWG conductor, foamed and crosslinked in a nitrogen gas environment at elevated temperature and pressure. Table 4 gives the formulations and process conditions for Example 5. HFDC-0692, available from Union Carbide, was used as the base material for the insulation shield.

TABLE 4

| Example | Foaming Agent/ Type | Insulation Shield Composition | Insulation | CV Curing Process Conditions | Linespeed (fpm) |
|---|---|---|---|---|---|
| 5 | Hydrocerol CT1267 Endothermic | 96% by weight HFDC-0692 (EVA-based insulation shield material) 4% by weight CT1267 (60% Active content in EVA carrier) | TRXLPE | $N_2$ at 135 psi and tube zone temperatures: 750/750/750/725/725/700 F. | 40 |

The foamed insulation shield of Example 5 achieved a density reduction of about 10% and had good surface quality. This example shows how the use of a purely endothermic foaming agent does not result in as great a density reduction of the insulation shield with similar active content of chemical foaming agent.

Figure 6:
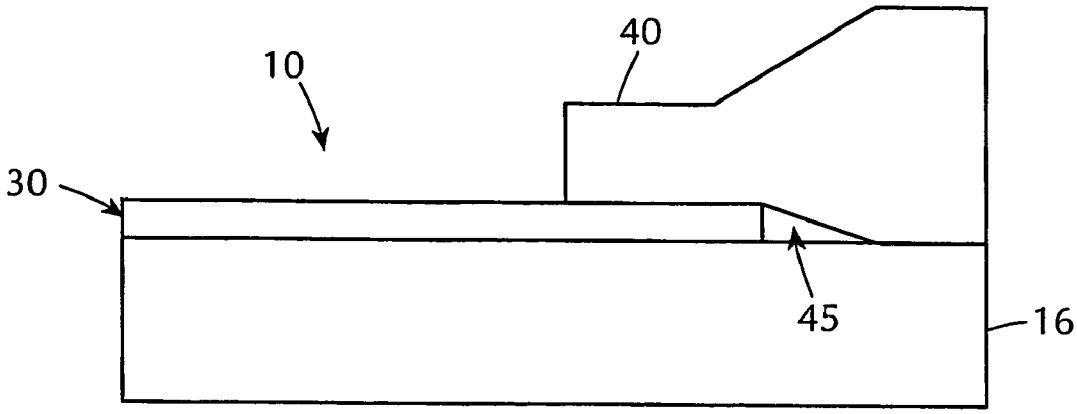
FIG. 6 is an illustration of a cable splice depicting a void space between the termination sleeve and a conventional insulation shield.
Figure 7:
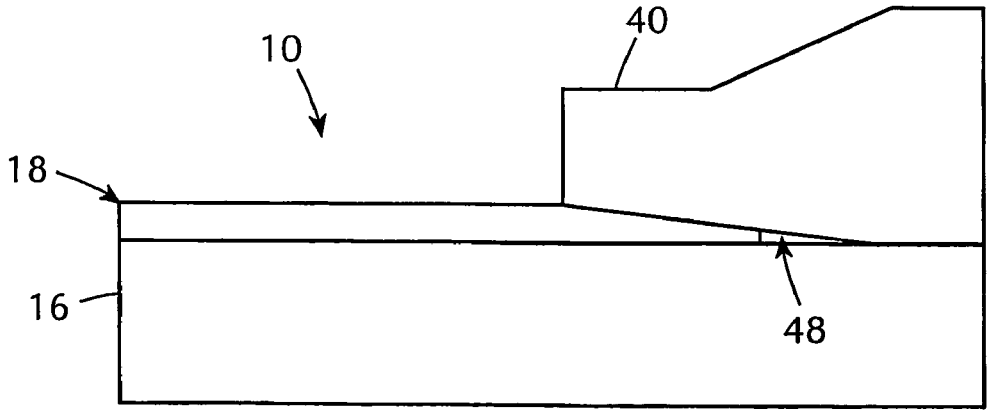
FIG. 7 is an illustration of a cable splice depicting the reduced void space between the termination sleeve and the insulation shield of the present invention.

Furthermore, the cable of the present invention with a foamed insulation shield enhances accessory reliability as illustrated in FIGS. 6 and 7. Referring to FIG. 6, when an electrical cable 10 having a conventional, non-foamed insulation shield 30 is terminated or spliced, a large void area 45 between the insulation layer 16 and the splice or termination sleeve 40 results as the insulation shield 30 has compression resistance. These large voids are normally filled with grease; however, it is difficult to fill the void completely. Because of this, the voids can potentially cause failure of the termination or splice due to partial discharge which will eventually erode the insulation. Using the foamed insulation shield 18 of the present invention as illustrated in FIG. 7, however, the insulation shield 18 compresses under the sleeve 40 when terminating or splicing the cable 10 and will substantially conform to the sleeve 40. Therefore, a significantly smaller void area 48 between the insulation layer 16 and the sleeve 40 results. This small void is more easily filled and requires less grease. The ability of the foamed insulation shield 18 to deform under pressure, such as that pressure which results from sleeve 40, allows enhanced reliability of terminations and splices to cables of the present invention.

What is claimed is:

1. An electric power cable, comprising:

a conductor;

a semiconductive conductor shield overlaying said conductor;

a crosslinked insulation layer formed over said conductor shield; and a foamed crosslinked semiconductive insulation shield positioned over and adhered to said insulation layer, wherein foaming of said foamed insulation shield is obtained after extrusion of said insulation shield onto said insulation layer.

2. The electric power cable of claim 1, wherein an interface between said insulation layer and said foamed insulation shield is substantially void free.

3. The electric power cable of claim 1, wherein said foamed insulation shield has a closed cell structure.

4. The electric power cable of claim 3, wherein said insulation shield is comprised of a base material comprised of a crosslinkable ethylene acetate selected from the group consisting of EVA, ERA, and EBA.

5. The electric power cable of claim 4, wherein said chemical foaming agent is comprised of a masterbach.

6. The electric power cable of claim 5, wherein said masterbach is comprised of a carrier selected from the group consisting of EVA, ERA, and EBA, and an active chemical foaming ingredient.

7. The electric power cable of claim 6, wherein said carrier has a MFI higher than that of said insulation shield.

8. The electric power cable of claim 5, wherein said chemical foaming agent comprises from about 1% to about 8% by weight of said insulation shield.

9. The electric power cable of claim 1, further comprising a metallic shield overlaying said foamed insulation shield.

10. The electric power cable of claim 1, wherein foaming of said foamed insulation shield is obtained by:

adding a chemical foaming agent having a decomposition temperature to said insulation shield prior to extrusion; and decomposing said chemical foaming agent at greater than atmospheric pressure after extrusion of said insulation shield onto said insulation layer.

11. The electric power cable of claim 10, wherein said insulation shield is comprised of a base material comprised of a crosslinkable ethylene acetate selected from the group consisting of EVA, EBA, and EEA.

12. The electric power cable of claim 1, wherein said chemical foaming agent is selected from the group consisting of exothermic foaming agents, endothermic foaming agents, and hybrid exothermic/endothermic foaming agents.

13. The electric power cable of claim 1, wherein said chemical foaming agent is an exothermic foaming agent and wherein said pressure is greater than or equal to about 135 psi.

14. The electric power cable of claim 13, wherein a catalyst is added to said insulation shield prior to extrusion onto said insulation layer.

15. The electric power cable of claim 1, wherein foaming of said insulation shield causes from about 10% to about 40% density reduction of said insulation shield.

16. A method of producing an electrical power cable, comprising:

advancing an electrical conductor through an extrusion crosshead;

extruding a semiconductive conductor shield over the electrical conductor;

extruding a cross-linkable electrical insulation layer over the conductor shield;

extruding a semiconductive, crosslinkable insulation shield material which includes a chemical foaming agent over the insulation layer; and after the extruding, performing the following steps:

heating the conductor shield, the insulation layer and the insulation shield to a temperature equal to or greater than the decomposition temperature of the chemical foaming agent to decompose the chemical foaming agent;

crosslinking the insulation shield material;

crosslinking the insulation layer;

crosslinking the conductor shield; and foaming the insulation shield.

17. The method of claim 16, wherein the chemical foaming agent has a decomposition temperature and a processing temperature.

18. The method of claim 17, wherein said extruding step is done at a temperature less than the decomposition temperature of the chemical foaming agent.

19. The method of claim 17, wherein the chemical foaming agent is an exothermic foaming agent and wherein the insulation shield material further comprises a catalyst which lowers the decomposition temperature of the chemical foaming agent.

20. The method of claim 17, wherein the insulation shield is maintained within the processing temperature range of the foaming agent in said heating step for at least about 1 minute.

21. The method of claim 16, wherein said heating step is done at greater than atmospheric pressure.

22. The method of claim 21, wherein said heating step is done at a pressure greater than about 135 psi.

23. The method of claim 16, further comprising: cooling the electrical power cable after said foaming step.

24. The method of claim 23, further comprising applying a metallic shield over the foamed insulation shield after said cooling step.

25. The method of claim 16, wherein said heating step is done at about 600° F. to about 750° F.

26. The method of claim 16, wherein said heating step is done at about greater than 370° F.

27. The method of claim 16, wherein said three extruding steps are done simultaneously.

28. The method of claim 16, wherein said three crosslinking steps and said foaming step are done substantially concurrently.

29. A method of producing an electrical power cable, comprising:

advancing an electrical conductor through an extrusion crosshead;

extruding a semiconductive conductor shield over the electrical conductor;

extruding a cross-linkable electrical insulation layer over the conductor shield;

extruding a semiconductive, crosslinkable insulation shield material which includes a chemical foaming agent having a decomposition temperature and a processing temperature range, over the insulation layer, said extruding being done at a temperature less than the decomposition temperature of the chemical foaming agent; and after the extruding, performing the following steps:

heating the electrical power cable with the conductor shield, the insulation layer and the insulation shield to a temperature equal to or greater than the decomposition temperature of the chemical foaming agent to decompose the chemical foaming agent, said heating being done at greater than atmospheric pressure;

crosslinking the insulation shield material;

crosslinking the insulation layer;

crosslinking the conductor shield; and foaming the insulation shield.

30. The method of claim 29, further comprising: cooling the electrical power cable after said foaming step; and applying a metallic shield over the foamed insulation shield after said cooling step.

31. The method of claim 29, wherein said heating step is done at a pressure greater than about 135 psi.

32. The method of claim 29, wherein the chemical foaming agent is an exothermic foaming agent and wherein the insulation shield material further comprises a catalyst which lowers the decomposition temperature of the chemical foaming agent.

33. The method of claim 29, wherein said heating step is done at about 600° F. to about 750° F.

34. The method of claim 29, wherein said heating step is done at about greater than 370° F.

35. The method of claim 29, wherein said three extruding steps are done simultaneously.

36. The method of claim 29, wherein said three crosslinking steps and said foaming step are done substantially concurrently.

37. The method of claim 29, wherein the insulation shield is maintained within the processing temperature range of the foaming agent in said heating step for at least about 1 minute.

* * * * *

UNITED STATES PATENT AND TRADEMARK OFFICE

CERTIFICATE OF CORRECTION

PATENT NO. : 7,208,682 B2
APPLICATION NO. : 10/537707
DATED : April 24, 2007
INVENTOR(S) : Kuchta et al.

It is certified that error appears in the above-identified patent and that said Letters Patent is hereby corrected as shown below:

Column 3, Line 16, “use:” should read -- use. --

Column 13, Line 65, “EVA, ERA, and EBA.” should read -- EVA, EBA, and EEA. --

Column 14, Line 17, “EVA, ERA, and EBA,” should read -- EVA, EBA, and EEA, --

Signed and Sealed this

Eighteenth Day of December, 2007

JON W. DUDAS
*Director of the United States Patent and Trademark Office*